US008558720B2

(12) United States Patent
Laurgeau et al.

(10) Patent No.: US 8,558,720 B2
(45) Date of Patent: Oct. 15, 2013

(54) INFORMATION SYSTEM AND METHOD FOR TRAFFIC IN ROAD NETWORK

(75) Inventors: Claude Laurgeau, Le Vesinet (FR); Arnaud de la Fortelle, Le Pecq (FR); Bruno Steux, Le Vesinet (FR)

(73) Assignee: Association pour la Recherche et le Developpement de Methodes et Processus Industruels "Armines", Paris (FR)

( * ) Notice: Subject to any disclaimer, the term of this patent is extended or adjusted under 35 U.S.C. 154(b) by 228 days.

(21) Appl. No.: 12/933,618

(22) PCT Filed: Mar. 19, 2009

(86) PCT No.: PCT/FR2009/050463

§ 371 (c)(1),
(2), (4) Date: Dec. 20, 2010

(87) PCT Pub. No.: WO2009/122107

PCT Pub. Date: Oct. 8, 2009

(65) Prior Publication Data

US 2011/0115648 A1 May 19, 2011

(30) Foreign Application Priority Data

Mar. 20, 2008 (FR) ..... 08 51809

(51) Int. Cl.
*G08G 1/065* (2006.01)

(52) U.S. Cl.
USPC ..... 340/934; 340/933; 340/995.13; 701/118

(58) Field of Classification Search
USPC ..... 340/934
See application file for complete search history.

(56) References Cited

U.S. PATENT DOCUMENTS

| | | | | |
|---|---|---|---|---|
| 5,933,100 | A * | 8/1999 | Golding | 340/995.13 |
| 6,124,807 | A * | 9/2000 | Heckeroth et al. | 340/908 |
| 2006/0058941 | A1 * | 3/2006 | DeKock et al. | 701/117 |

FOREIGN PATENT DOCUMENTS

| | | |
|---|---|---|
| EP | 1 591 980 | 11/2005 |
| WO | WO 00/31705 | 6/2000 |

OTHER PUBLICATIONS

Furtlehner et al., "A Belief Propagation Approach to Traffic Prediction using Probe Vehicles", Oct. 3, 2007, IEEE Intelligent Transportation Systems Conference, pp. 1022-1027.*

* cited by examiner

*Primary Examiner* — Kerri McNally
(74) *Attorney, Agent, or Firm* — Cozen O'Connor

(57) ABSTRACT

The information system concerning traffic in a road network (R) comprises a server (30) comprising: means (34) for obtaining at least one real duration ($DE_{AB}$) of a run traveled by at least one vehicle (5) between two points (A, B) of the network, on the basis of information transmitted by a device (10) on board said vehicle (5); means (31) for statistically calculating, on the basis of said real durations ($DR_{AB}$), an estimated duration ($DE_{AB}$) for a run between two points (A, B) of the network; and means (34) for making the estimated duration ($DE_{AB}$) available to at least one terminal (40, 10).

9 Claims, 3 Drawing Sheets

INFORMATION SYSTEM AND METHOD FOR TRAFFIC IN ROAD NETWORK

RELATED APPLICATIONS

This is a U.S. National Phase Application under 35 USC §371 of International Application PCT/FR2009/050463, filed on Mar. 19, 2009.

This application claims the priority of French application no. 08/51809 filed on Mar. 20, 2008, and the content of which is hereby incorporated by reference.

BACKGROUND OF THE INVENTION

The invention relates to an information system and method concerning traffic in a road network.

In the present state of the art, road traffic is measured essentially by counting vehicles traveling on the network.

In particular, it is known to use magnetic loops buried in the roadway and suitable for detecting the passage of vehicles. Information is collected by local units and transferred to a traffic management center where the information is aggregated.

Technologies based on magnetic loops are reliable, but complex to implement and expensive in that they require road works and maintenance. This explains why they are present only in large cities in countries that are economically advanced.

In order to limit infrastructure costs, proposals have been made to replace magnetic loops by video cameras installed along the roadway.

However both of those techniques present the major drawback of serving to measure road traffic only at points of the network where vehicle detector devices are installed, i.e. magnetic loops, or video cameras, or other sensors.

OBJECT AND SUMMARY OF THE INVENTION

One object of the present invention is to provide an information system and method concerning traffic in a road network that do not present the drawbacks of the above-mentioned systems and methods.

This and other objects are attained in accordance with one aspect of the present invention directed to an information system concerning traffic in a road network, the system comprising a server, the server comprising:

- means for obtaining at least one real duration of a run traveled by at least one vehicle between two points of the network, on the basis of information transmitted by a device on board said vehicle;
- means for statistically calculating an estimated duration of a run between two points of a network on the basis of said real durations;
- and means for making the estimated duration available to at least one terminal.

Another aspect of the invention is directed to an information method concerning traffic in a road network, said method being suitable for being implemented by a server and comprising:

- a step of obtaining at least one real duration of a run traveled by at least one vehicle between two points of said network, on the basis of information transmitted by a device on board said vehicle;
- a step of statistically calculating an estimated duration of a run between two points of the network, on the basis of said real durations; and
- a step during which said estimated duration is made available to at least one terminal.

The server of the system of the invention may be administered at a traffic management center.

In general, the information system and method of the invention serve to estimate the duration of a run between two points of the network on the basis of durations of runs that have really been traveled by vehicles on the network.

In most advantageous manner, the invention does not require any intervention on the road network and it may therefore be deployed at very low cost, even in zones that are poorly developed.

The key idea of the invention is to have traffic measured not by infrastructure but rather by the vehicles themselves.

As a corollary, operation of the invention no longer relies, as in the prior art, on measuring vehicle flow rates, but rather on measuring actual vehicle run times.

In this context, it is advantageous to observe that the variable message panels that in the present state of the art display information on run durations between two points of the network obtain that information not from real measurements of run times, but on the basis of measuring vehicle flow rates on the network.

The person skilled in the art will understand that in order to be reliable and pertinent, prior art methods require a very large number of flow rate measurements and require complex prediction methods to be implemented that are based on conservation assumptions.

The present invention does not have those drawbacks, and its run time predictions can be very reliable as from the first measurement of a real run.

Furthermore, methods of the prior art allow traffic to be reconstructed only on segments fitted with equipment.

In contrast, the invention enables traffic to be reconstructed whenever vehicles go, and even in the immediate neighborhood vicinity thereof, by relying on historical correlations.

In a particular embodiment, the vehicles carry devices that are suitable themselves for measuring the real durations of runs between two points on the network and for transmitting these real durations to the server via wireless communications means.

In a variant, the devices on board the vehicles communicate the instants at which they go past various points of the network, with the server itself calculating the real durations of the runs traveled between two points of the network on the basis of that information.

In any event, the statistical calculations are performed on the basis of real run durations.

In a particular embodiment, the devices on board the vehicles transmit information to the server via relays, rather than transmitting directly.

These relays (or letter boxes) may be constituted in particular by hot spots of the WiFi, WinMax or DSRC type.

In a particular implementation of the invention, the real run durations are measured between predetermined points of the network, these points being stored in a table of the device.

From a conceptual point of view, these predetermined points replace the magnetic loops and video cameras of the prior art.

Since these points are virtual, they may advantageously be increased in number or moved any number of times and at no cost, thus providing total flexibility in establishing a mesh in a built-up area or over a territory in a rural zone, in particular.

A point of the network is preferably defined by its coordinates in the global positioning system (GPS).

It will be understood that the predetermined points may be located at the same positions as the above-mentioned relays, or elsewhere.

In a particular embodiment of the invention, the statistical calculation means operate not directly on the real run durations between two points of the network, but on the basis of real durations between pairs of points, each pair of points defining a segment, and successive segments having an end in common.

This method, based on the "belief propagation" technique is associated with an approach of correlating traffic between adjacent segments. It is described in detail in the publication by C. Furtlehner, J. Lasgouttes, and A. La Fortelle (2007) "A belief propagation approach to traffic prediction using probe vehicles", in Proceedings of ITSC'07.

The main advantage lies in a method that is simple, fast, and very well adapted to the type of data obtained by a system of probe vehicles, in particular data that is sparse and noisy.

In this embodiment, the traffic reconstruction calculation, where reconstruction includes estimating past and present states and also predicting future states, takes place in two steps.

In a first step, on the basis of historical data (probably collected by probe vehicles), the parameters of the system are calculated, i.e. conditional probabilities between pairs of segments (in principle arcs of the graph of the space-time network) together with the marginal probability of each segment, thus constituting a step of characterizing the system.

Thereafter, on the basis of the data that arrives in real time (the data for the period under consideration for reconstruction, i.e. usually one day), the state of the traffic is calculated (for one day), conditional on the real data and as a function of the characterization of the system. This is the reconstruction step proper. Both steps make use of the "belief propagation" algorithm.

The durations estimated between two run points may be made available to users in various ways.

In one embodiment, the estimated run durations are published by being displayed on variable message panels that are present on road networks.

In a variant, this information may be published by the server on a web site that is accessible by a user terminal.

The information may also be transmitted by the server to terminals on board the vehicles via wireless communications means.

In a particular embodiment, the various steps of the information method are determined by computer program instructions.

Another aspect of the invention is directed to a computer program on a data medium, the program being suitable for being implemented in a server or more generally on a computer, the program including instructions adapted to implementing steps of an information method as described above.

The program may use any programming language and it may be in the form of source code, object code, or code intermediate between source code and object code, such as in a partially compiled form, or in any other desirable form.

Another aspect of the invention is directed to a data medium readable by a computer, and including instructions of a computer program as mentioned above.

The data medium may be any entity or device capable of storing the program. For example, the medium may comprise storage means such as a read only memory (ROM), e.g. a compact disk (CD) ROM, or a microelectronic circuit ROM, or indeed magnetic recording means, e.g. a floppy disk or a hard disk.

Furthermore, the data medium may be a transmissible medium such as an electrical or optical signal suitable for being conveyed by electrical or optical cable, by radio, or by other means. The program of the invention may in particular be downloaded from an Internet type network.

Alternatively, the data medium may be an integrated circuit in which the program is incorporated, the circuit being adapted to executed or to be used in the execution of the method in question.

BRIEF DESCRIPTION OF THE DRAWINGS

Other characteristics and advantages of the present invention appear from the following description made with reference to the accompanying drawings that show an embodiment having no limiting character. In the figures.

DETAILED DESCRIPTION OF THE DRAWINGS

Figure 1:
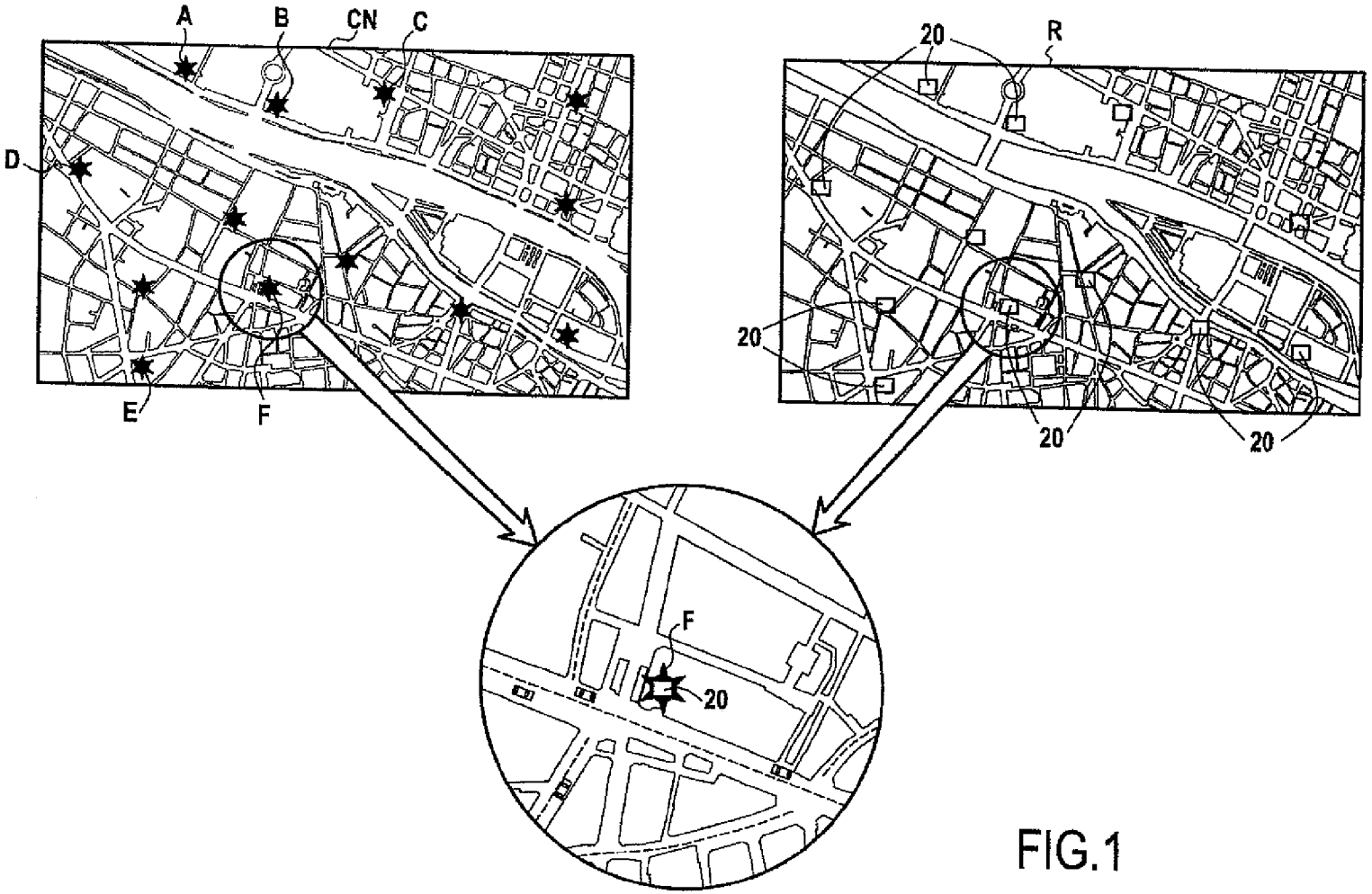
FIG. 1 shows a road network and a digital map of the network suitable for use in the invention.

FIG. 1 shows a road network R having a certain number of relays 20 located thereon, and also a digital map CN of the network R, on which map a certain number of predetermined points A, B, . . . are defined.

In the embodiment described herein, and as shown in the enlargement of FIG. 1, the determined point F is positioned on the digital map CN at the location of a relay 20 of the road network R. This does not apply to all of the predetermined points.

Figure 2:
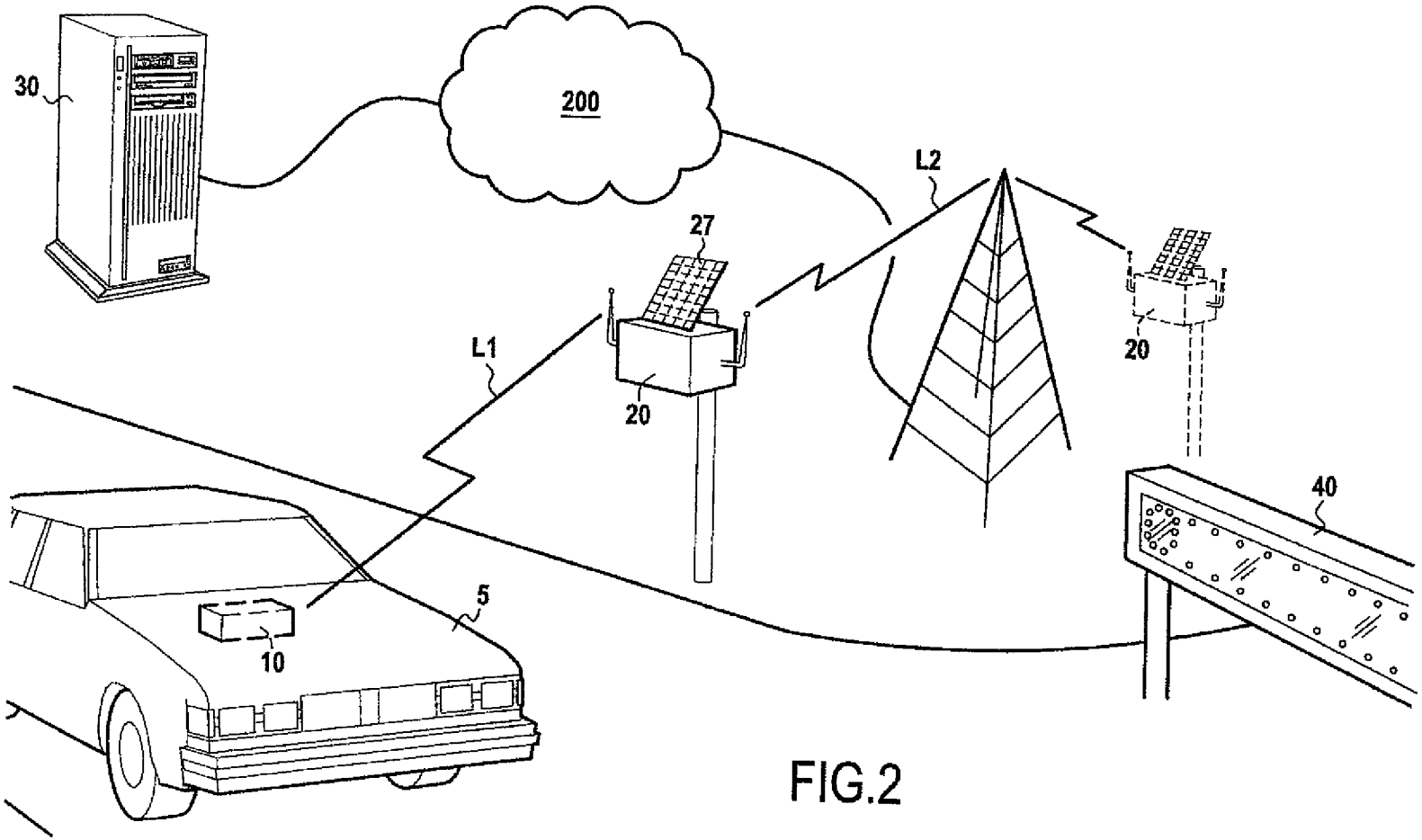
FIG. 2 shows an information system in accordance with the invention in a particular embodiment.

FIG. 2 shows an information system in accordance with the invention.

In the example described herein, the system comprises a server 30 managed by a road traffic management center, a certain number of relays 20, devices 10 on board vehicles 5, and a variable message panel 40.

In the embodiment described herein, the relays 20 are powered by solar panels 27. These relays 20 are adapted to communicate over a WiFi link L1 with the devices 10 on board the vehicles 5 and with the server 30 via a universal mobile telecommunications system (UMTS) link L2 and the Internet 200.

Figure 3:
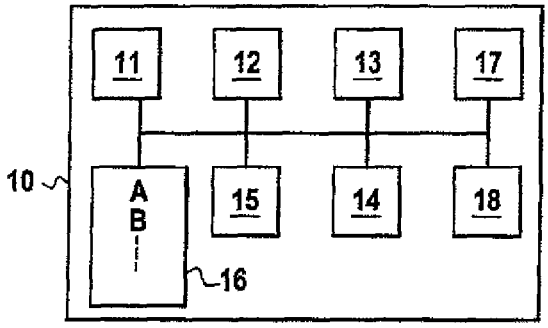
FIG. 3 is a diagram of a device suitable for mounting on board a vehicle to implement a particular embodiment of the invention.

FIG. 3 is a diagram showing the hardware architecture of a device 10 on board a vehicle 5.

The device 10 has the hardware architecture of a computer.

It comprises in particular a processor 11, a ROM 13, a random access memory (RAM) 12, a rewritable non-volatile memory of the Flash type 17, and means 14 for wireless communication with the relays 20.

The device 10 also includes location-determining means constituted in this example by a GPS module 15, a table 16 having recorded therein the GPS coordinates of the predetermined points A, B, . . . of the digital map CN, and a timer 18.

The operation of the device 10 is described below.

When the processor 11, using the GPS module 15, detects that the device 10 is close to one of the points A, B, . . . of the table 16, it triggers the timer 18.

Then, when the processor 11 determines that the device 10 is close to another one of the points B stored in the table 10, it obtains from the timer 18 the real duration of the run between the points A and B of the network. These durations are stored in the rewritable non-volatile memory 17.

Thereafter, when the device 10 is within range of a relay 20 it transmits the real run durations as stored in its rewritable non-volatile memory 17 to the server 30 via said relay.

Figure 4:
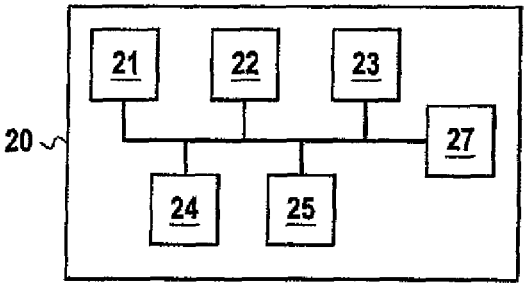
FIG. 4 is a diagram showing the hardware architecture of a relay suitable for use in a particular embodiment of the invention.

FIG. 4 shows the hardware architecture of a relay 20 in a particular embodiment.

The relay 20 has the hardware architecture of a computer. In particular it comprises a processor 21, a ROM 23, a RAM 22, WiFi communications means 24 for communicating with a device 10 on board a vehicle 5, UMTS communications means 25 for transmitting information to a server 30, and a solar panel 27.

Figure 5:
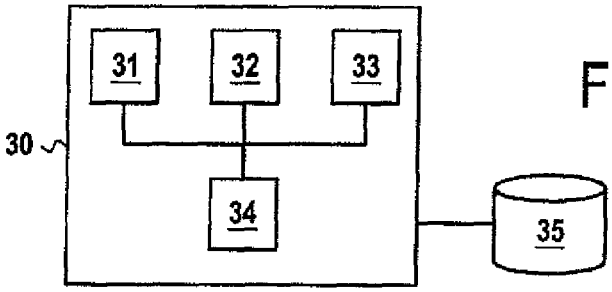
FIG. 5 shows the hardware architecture of a server suitable for use in a particular embodiment of the invention.

FIG. 5 shows the hardware architecture of a sever 30 suitable for use in an information system in accordance with the invention.

The server 30 has the hardware architecture of a computer. It comprises a processor 31, a ROM 33, a RAM 32, and communications means 34 for communicating with the Internet 200.

The ROM 33 constitutes a recording medium in accordance with the invention, in which there is recorded a computer program in accordance with the invention for executing the information method in accordance with the invention, the main steps of which are described below with reference to FIG. 6.

The communications means 34 are adapted to receive the real run durations from the on-board devices 10 in the vehicles, and to use this real data to perform a statistical calculation to estimate the run durations between two points of the network.

In the embodiment described herein, it is assumed that these estimated run durations are firstly stored in a web site 35 and secondly transmitted to the various message panels 40.

Thus, users can be informed of the estimated run durations either by traveling close to a variable message panel, or via a terminal having access to the web site 35.

In the embodiment described herein, the estimated run durations are also communicated by the communications means 34 of the server 30 to the devices 10 on board the vehicles.

Figure 6:
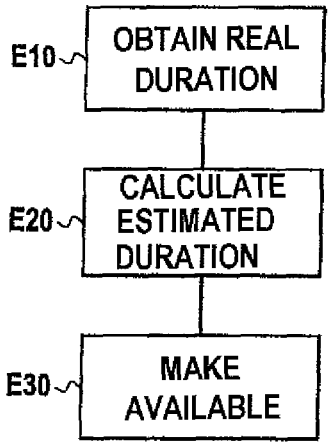
FIG. 6 is a flow chart showing the main steps of an information method in accordance with the invention in a particular implementation.

FIG. 6 is a flow chart showing the main steps of the information method in accordance with the invention in a particular embodiment. In this example, the method is implemented by the server 30.

It comprises a step E10 during which the server 30 receives the real run durations traveled by vehicles between two points of the network.

The method then comprises a step E20 of statistically calculating estimated run durations between two points of the network on the basis of the real durations received in step E10.

In the embodiment described herein, this statistical calculation step uses the above-mentioned belief propagation algorithm.

The information method in accordance with the invention finally includes a step E30 making the estimated durations available to a certain number of terminals, by publication on the web site 35 and by transmissions to the terminals 10 and to the variable message panels 40.

The invention claimed is:

1. An information system concerning traffic in a road network, the system comprising a server having means for making available to at least one terminal an estimated duration for a run between two points of the network, wherein said server comprises:

means for obtaining at least one real duration of a run traveled by at least one vehicle between two points of said network on the basis of information transmitted by a device on board the vehicle; and means for statistically calculating said estimated duration on the basis of said real durations, wherein at least one of said points of said network is a predetermined point, stored in a table of said device and said predetermined point is the position of a relay.

2. The information system according to claim 1, comprising at least one said device suitable for measuring said real duration and for transmitting it to said server via wireless communications means.

3. The information system according to claim 2, comprising at least one relay suitable for receiving the real duration transmitted by said device and or relaying it to said server.

4. The information system according to claim 3, wherein said relay is a fixed telecommunications base installed in said road network.

5. The information system according to claim 1, wherein said statistical calculation means use pairs of said points defining segments, of said segments having one end in common.

6. The information system according to claim 1, wherein said means for making said estimated duration available comprise a web site that is accessible by said terminal.

7. The information system according to claim 1, wherein said terminal is on board a vehicle, and wherein said means for making said estimated duration available comprise wireless communications means suitable for transmitting said estimated duration to said terminal.

8. An information method concerning traffic in a road network, the method being suitable or implemented by a server suitable for making available to at least one terminal an estimated duration of a run between two points of the network, wherein said method comprises:

a step of obtaining at least one real duration of a run traveled by at least one vehicle between two points of said network, on the basis of information transmitted by a device on board said vehicle; and a step of statistically calculating said estimated duration on the basis of said real durations, wherein at least one of said points of said network is a predetermined point, stored in a table of said device and said predetermined point is the position of a relay.

9. A non-transitory recording medium readable by a computer and having recorded thereon a computer program including instructions for executing the steps of the information method according to claim 8.

* * * * *